US011707693B2

(12) United States Patent
McGrath et al.

(10) Patent No.: US 11,707,693 B2
(45) Date of Patent: Jul. 25, 2023

(54) WIND-UP RIDE ON TOY

(71) Applicant: Jakks Pacific Inc., Santa Monica, CA (US)

(72) Inventors: Jack McGrath, Santa Monica, CA (US); Damian Mucaro, Hackensack, NJ (US)

(73) Assignee: JAKKS PACIFIC INC., Santa Monica, CA (US)

( * ) Notice: Subject to any disclaimer, the term of this patent is extended or adjusted under 35 U.S.C. 154(b) by 0 days.

(21) Appl. No.: 17/243,463

(22) Filed: Apr. 28, 2021

(65) Prior Publication Data

US 2021/0346817 A1 Nov. 11, 2021

Related U.S. Application Data

(60) Provisional application No. 63/020,842, filed on May 6, 2020.

(51) Int. Cl.

| | |
|---|---|
| ***A63H 29/18*** | (2006.01) |
| ***A63H 17/38*** | (2006.01) |
| ***A63H 31/00*** | (2006.01) |
| ***A63H 29/24*** | (2006.01) |

(52) U.S. Cl.

CPC ..... *A63H 29/18* (2013.01); *A63H 17/38* (2013.01); *A63H 29/24* (2013.01); *A63H 31/00* (2013.01)

(58) Field of Classification Search

CPC ..... A63H 29/18; A63H 29/24; A63H 17/38; A63H 31/00

See application file for complete search history.

(56) References Cited

U.S. PATENT DOCUMENTS

| | | | | | |
|---|---|---|---|---|---|
| 202,651 | A * | 4/1878 | Hoard | A63H 29/18 | 446/459 |
| 1,399,667 | A * | 12/1921 | Sladek | A63H 29/18 | 446/459 |
| 1,750,152 | A * | 3/1930 | Alland | A63H 29/18 | 446/414 |
| 1,762,461 | A * | 6/1930 | Alland | A63H 17/32 | 446/414 |
| 2,677,915 | A * | 5/1954 | Fasano | A63H 29/18 | 446/459 |

(Continued)

FOREIGN PATENT DOCUMENTS

JP H06254262 A * 9/1994

*Primary Examiner* — Eugene L Kim
*Assistant Examiner* — Alyssa M Hylinski
(74) *Attorney, Agent, or Firm* — Tope-McKay & Associates

(57) ABSTRACT

Described is a wind-up ride on toy with wind-up mechanism to propel a rider. The ride on toy comprises a body portion having a seat portion. A first axle is rotatably connected with the body portion, while a pair of wheels are connected with the first axle. The wind-up mechanism has an elastic band and a rotatable spool. The elastic band is fixed at a first end within the body portion and is attached with the rotatable spool at a second end. Additionally, the rotatable spool is operably connected with the first axle, such that winding the elastic band around the spool causes the elastic band to transition from a relaxed state to a stretched state and, upon allowing the elastic band to return to the relaxed state, the spool rotates the first axle and pair of wheels, thereby causing the wind-up ride on toy to propel forward.

4 Claims, 9 Drawing Sheets

(56) References Cited

U.S. PATENT DOCUMENTS

| | | | | | |
|---|---|---|---|---|---|
| 2,749,660 | A * | 6/1956 | Zimentstark | A63H 29/18 | 446/459 |
| 2,941,623 | A * | 6/1960 | Tarrson | A63H 29/18 | 185/37 |
| 3,068,614 | A * | 12/1962 | Fasano | A63H 29/18 | 446/459 |
| 3,601,924 | A * | 8/1971 | Lechner | A63H 29/18 | 446/459 |
| 3,611,631 | A * | 10/1971 | Folson | A63H 29/18 | 446/459 |
| 3,645,039 | A * | 2/1972 | Bross | A63H 29/18 | 446/459 |
| 3,959,921 | A * | 6/1976 | Klint | A63H 17/00 | 446/470 |
| 5,562,522 | A * | 10/1996 | Richno | A63H 18/00 | 446/459 |
| 2007/0007779 | A1* | 1/2007 | Thomson | B62K 9/02 | 293/107 |
| 2017/0007936 | A1* | 1/2017 | Bausch | A63H 17/008 | |
| 2020/0009466 | A1* | 1/2020 | Rope | A63H 17/262 | |

* cited by examiner

100

WIND-UP RIDE ON TOY

CROSS-REFERENCED TO RELATED APPLICATIONS

This is a non-provisional application of U.S. Provisional Application No. 63/020,842, filed on May 6, 2020, the entirety of which is incorporated herein by reference.

BACKGROUND OF THE INVENTION

(1) Field of Invention

The present invention relates to ride on toy and, more particularly, to a ride on toy with a wind-up mechanism to propel a rider.

(2) Description of Related Art

Ride on toys have long been known in the art. However, there are currently no ride-on toys as described and illustrated herein.

Thus, a continuing need exists for a new and improved ride-on toy.

SUMMARY OF INVENTION

The present disclosure provides a wind-up ride on toy. The ride on toy comprises a body portion having a seat portion. A first axle is rotatably connected with the body portion, while a pair of wheels are connected with the first axle. Further, a wind-up mechanism is attached with the body portion. The wind-up mechanism has an elastic band and a rotatable spool. The elastic band is fixed at a first end within the body portion and is attached with the rotatable spool at a second end. Additionally, the rotatable spool is operably connected with the first axle, such that winding the elastic band around the spool causes the elastic band to transition from a relaxed state to a stretched state and upon allowing the elastic band to return to the relaxed state, the spool rotates the first axle and pair of wheels, thereby causing the wind-up ride on toy to propel forward.

In another aspect, a plurality of gears are operably connected between the rotatable spool and the first axle.

In yet another aspect, the pair of wheels are a pair of rear wheels, while a second pair of wheels (i.e., front wheels) are also rotatably connected with the body portion.

Finally, as can be appreciated by one in the art, the present invention also comprises a method for forming and using the invention described herein. For example, the method comprises acts of seating a rider upon a seat portion of the wind-up ride on toy; drawing the wind-up ride on toy backwards, such that in drawing the wind-up ride on toy backwards, an elastic band within the toy stretches around a rotatable spool to stretch from a relaxed state to a stretched state; and releasing the wind-up ride on toy, such that upon releasing the wind-up ride on toy, the elastic band returns to the relaxed state and causes the spool to rotate, thereby rotating an axle and an attached pair of wheels and propelling the wind-up ride on toy and rider forward.

BRIEF DESCRIPTION OF THE DRAWINGS

The objects, features and advantages of the present invention will be apparent from the following detailed descriptions of the various aspects of the invention in conjunction with reference to the following drawings, where.

DETAILED DESCRIPTION

The present invention relates to ride on toy and, more particularly, to a ride on toy with a wind-up mechanism to propel a rider. The following description is presented to enable one of ordinary skill in the art to make and use the invention and to incorporate it in the context of particular applications. Various modifications, as well as a variety of uses in different applications will be readily apparent to those skilled in the art, and the general principles defined herein may be applied to a wide range of embodiments. Thus, the present invention is not intended to be limited to the embodiments presented, but is to be accorded the widest scope consistent with the principles and novel features disclosed herein.

In the following detailed description, numerous specific details are set forth in order to provide a more thorough understanding of the present invention. However, it will be apparent to one skilled in the art that the present invention may be practiced without necessarily being limited to these specific details. In other instances, well-known structures and devices are shown in block diagram form, rather than in detail, in order to avoid obscuring the present invention.

The reader's attention is directed to all papers and documents which are filed concurrently with this specification and which are open to public inspection with this specification, and the contents of all such papers and documents are incorporated herein by reference. All the features disclosed in this specification, (including any accompanying claims, abstract, and drawings) may be replaced by alternative features serving the same, equivalent or similar purpose, unless expressly stated otherwise. Thus, unless expressly stated otherwise, each feature disclosed is only one example of a generic series of equivalent or similar features.

Furthermore, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of" or "act of" in the claims herein is not intended to invoke the provisions of 35 U.S.C. 112, Paragraph 6.

Please note, if used, the labels left, right, front, back, top, bottom, forward, reverse, clockwise and counter-clockwise have been used for convenience purposes only and are not intended to imply any particular fixed direction. Instead, they are used to reflect relative locations and/or directions between various portions of an object.

(1) Description

Figure 1:
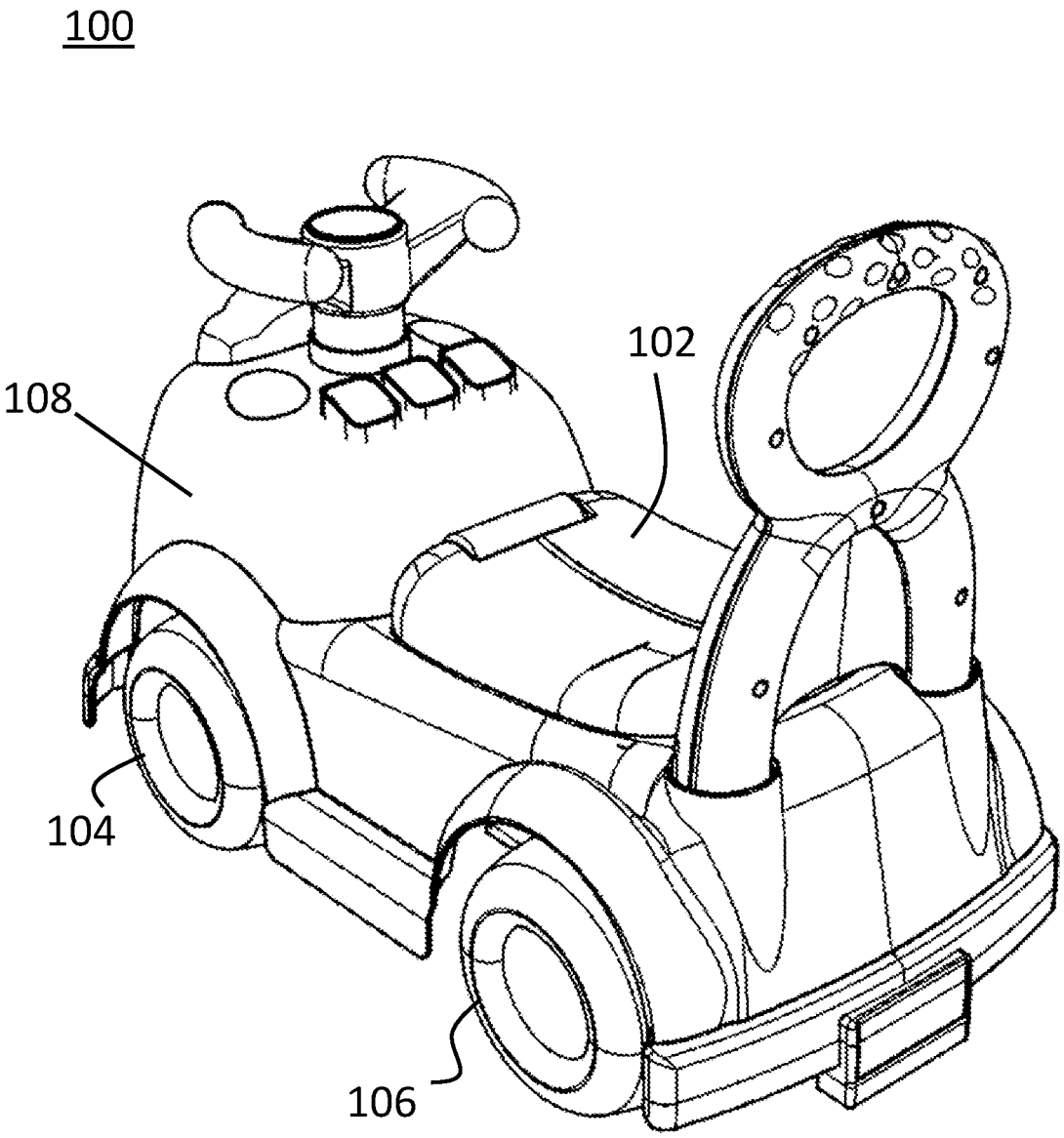
FIG. 1 is a rear, elevated view illustration of a wind-up ride on toy according to various embodiments of the present invention.
Figure 2:
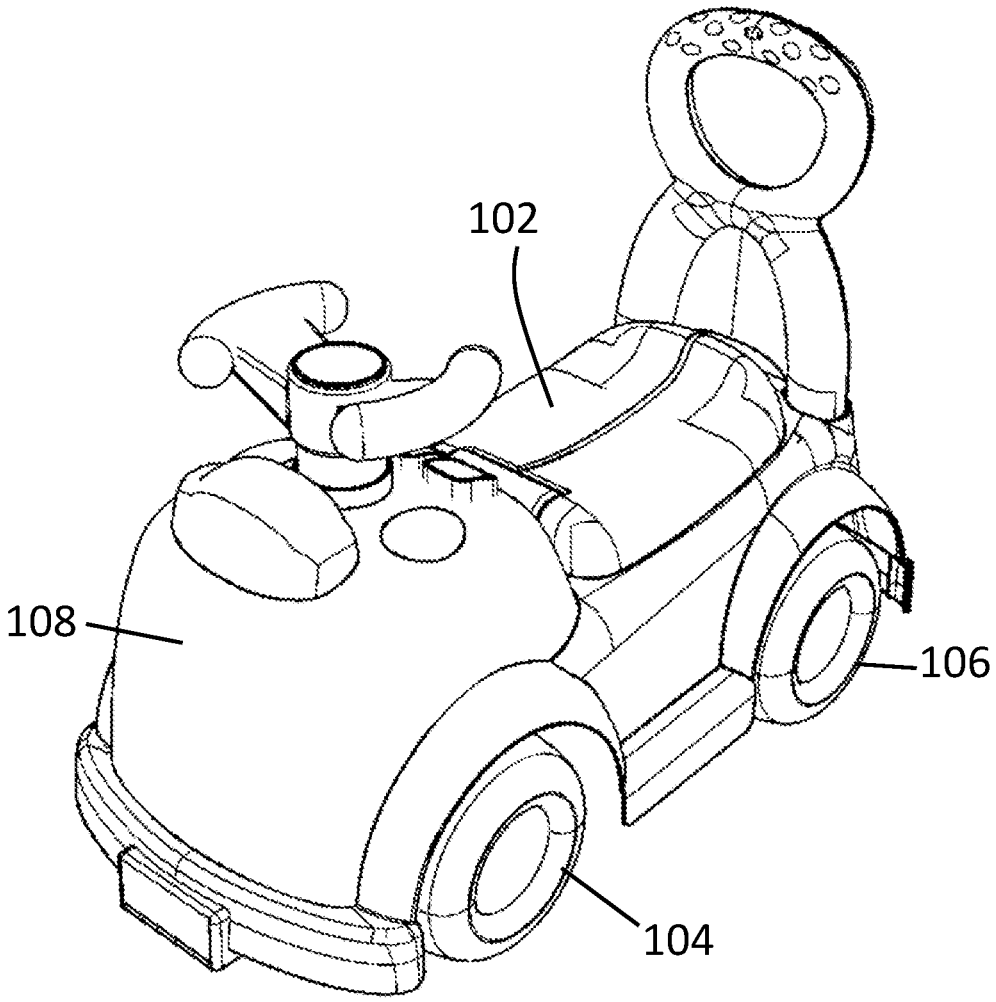
FIG. 2 is a front, elevated view illustration of the wind-up ride on toy according to various embodiments of the present invention.

As shown in FIGS. 1 and 2, the present disclosure provides a ride-on toy 100 with a wind-up mechanism to propel a rider. The ride-on toy 100 includes a seat portion 102 upon which the rider can sit, as well as a plurality of wheels (e.g., a pair of front wheels 104 and a pair of rear wheels 106) operably connected with a body portion 108. The seat portion 102 is sufficiently sized for a person to sit on it. For example, the seat portion 102 is between six and twenty four inches long, and between three and twelve inches wide, or any other desired dimension to accommodate a ride, such as a child. The plurality of wheels are operably connected with the body portion 108 via axles, or any other mechanism or device that allows the ride-on toy 100 to roll upon a surface and be propelled forward.

Figure 3:
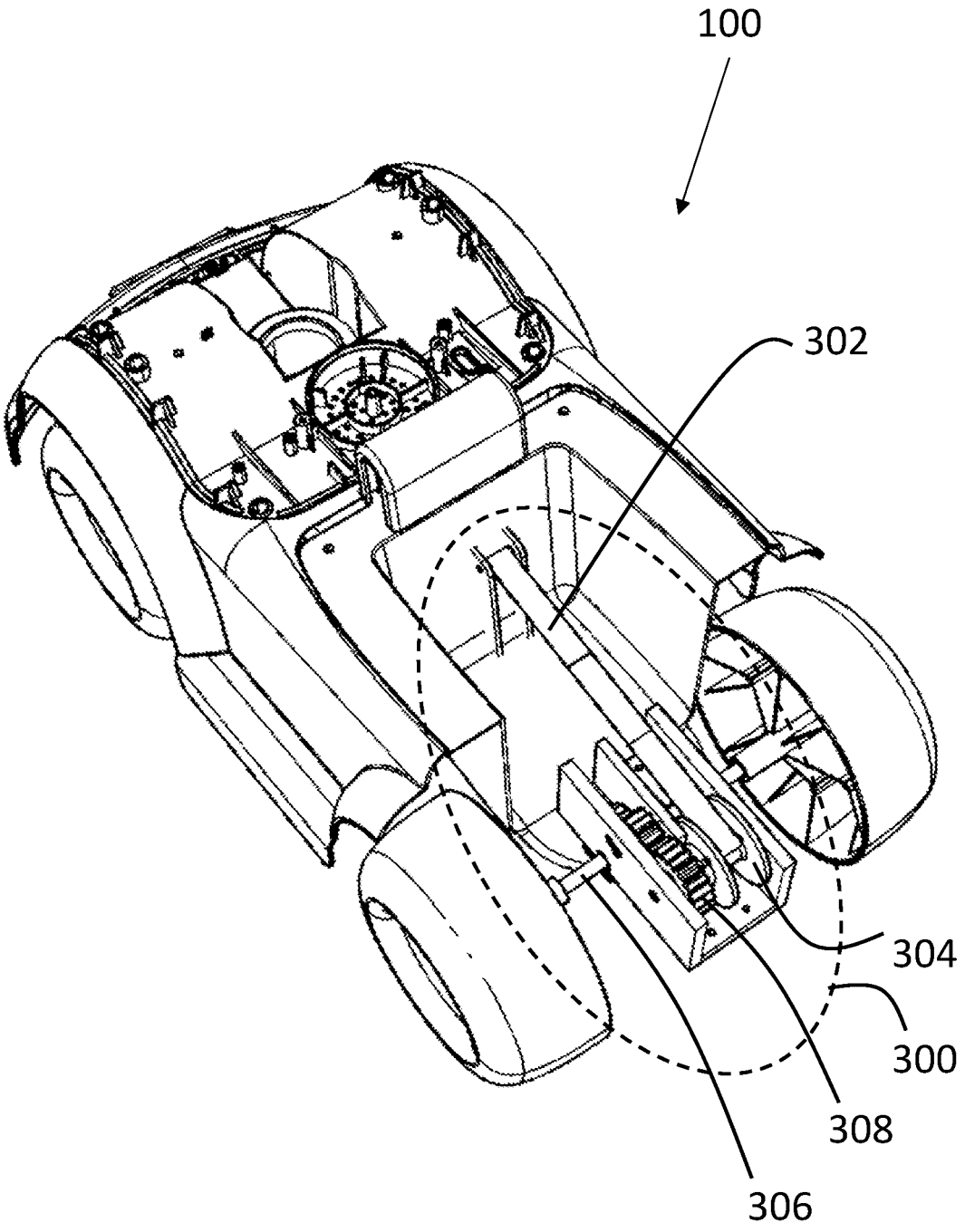
FIG. 3 is a top, interior-view illustration of the wind-up ride on toy according to various embodiments of the present invention.
Figure 4A:
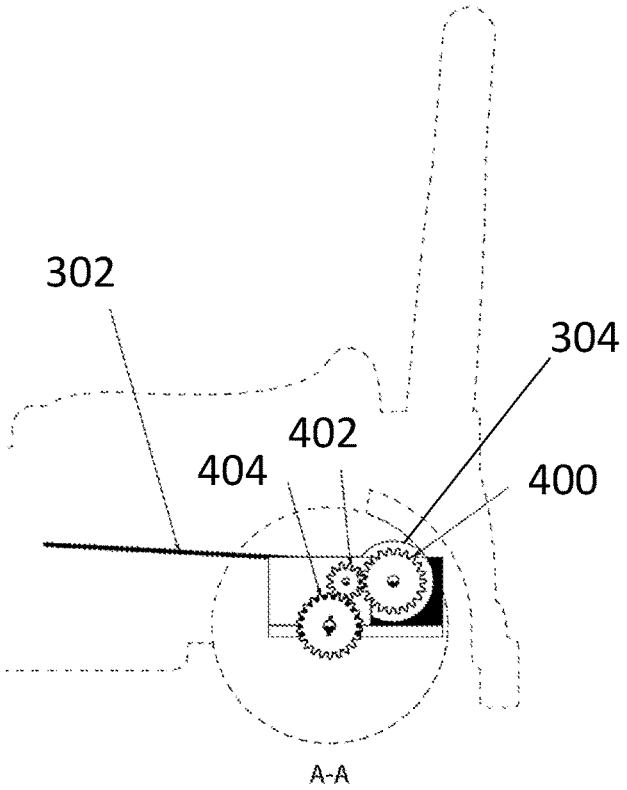
FIG. 4A is a side, cross-sectional view illustration of the wind-up ride on toy, taken from line A-A of FIG. 4B.
Figure 4B:
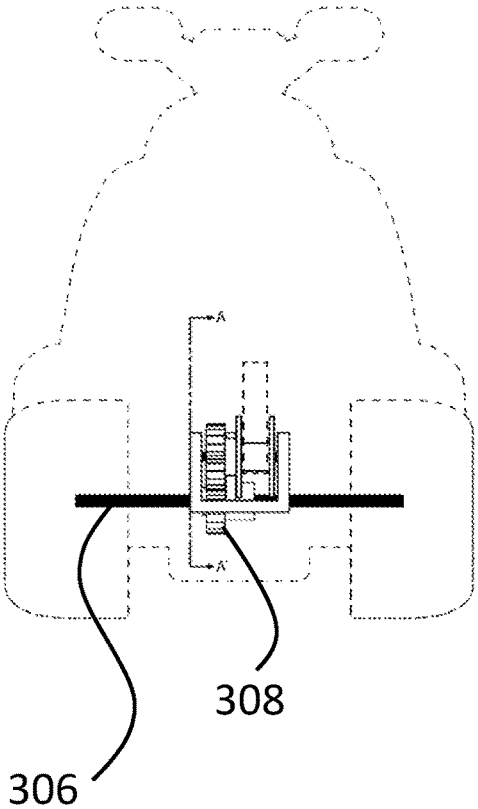
FIG. 4B is a rear, interior-view illustration of the wind-up ride on toy according to various embodiments of the present invention.
Figure 5:
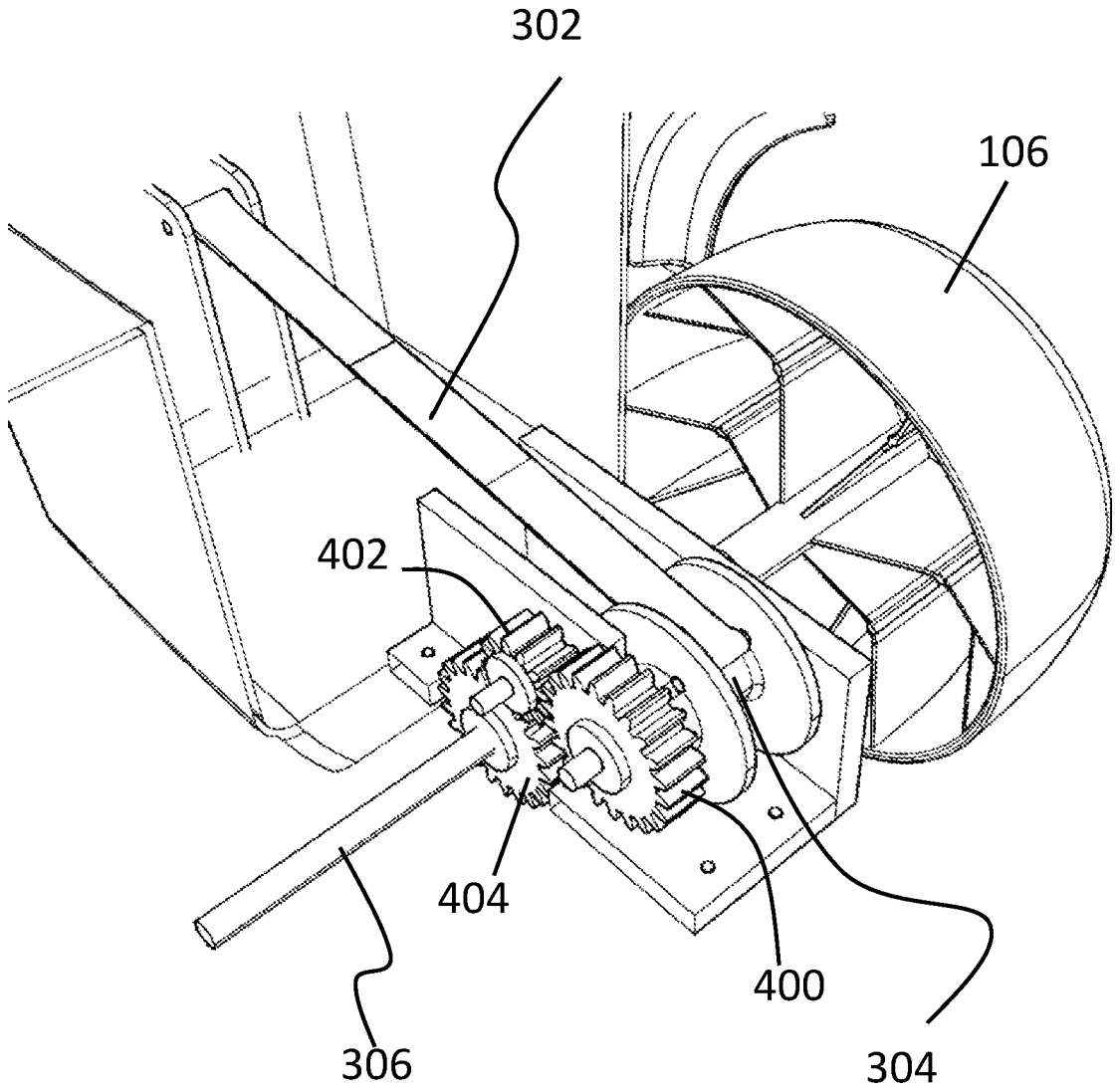
FIG. 5 is an interior-view illustration of a wind-up mechanism as used in the wind-up ride on toy according to various embodiments of the present invention.
Figure 6:
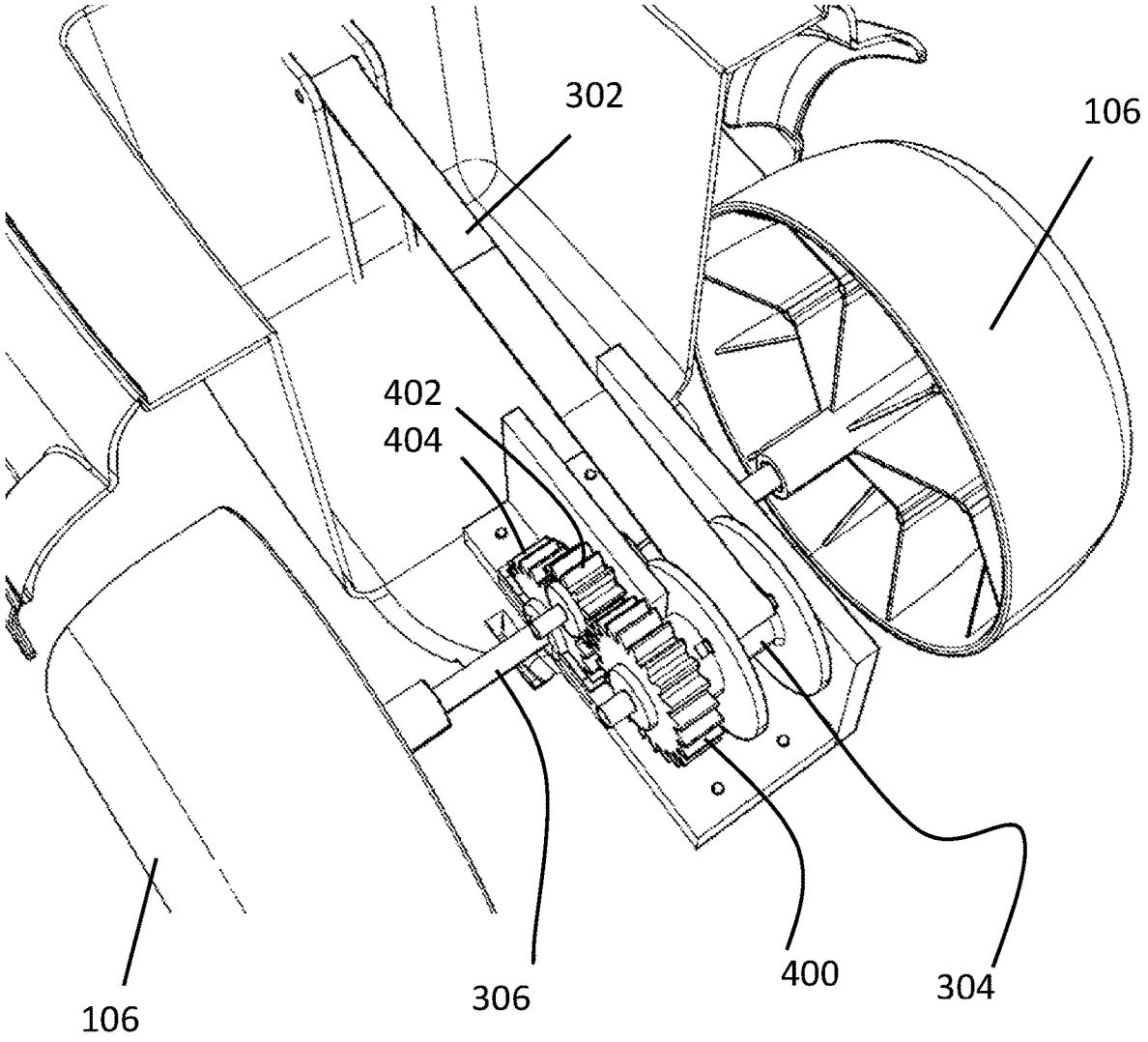
FIG. 6 is an interior-view illustration of the wind-up mechanism as used in the wind-up ride on toy according to various embodiments of the present invention.

The ride-on toy 100 is built to allow a child to sit upon the ride-on toy 100 and push oneself along a surface. Further and as shown in FIG. 3, within the ride-on toy 100 is a wind-up mechanism 300 that allows the rider to push the ride-on toy 100 backwards. In doing so, an elastic band 302 is stretched (to a stretched state) around a spool 304 that is operably attached to at least one of the axles (e.g., rear axles 306) of the toy 100. When stretched around the spool 304, the elastic band 300 provides for stored energy as it wants to return to an unstretched, relaxed state. When released (such as by the user lifting up their legs), the elastic band 300 pulls itself back to the relaxed, unstretched state. In doing so, the band 300 causes the spool 304 to rotate, which in turn is operably connected with the axle 306 to cause the ride-on toy 100 to be propelled forward.

Gearing 308 is desirably connected with and between the spool 304 and axle 306 to change the torque and/or speed at which the axle 306 and attached wheels rotate. For example, FIG. 4A through FIG. 6 depict the axle 306 as connected with the gears 308. The gears 308 include any gearing set up as desired to alter the torque and/or speed at which the axle 306 rotates. As a non-limiting example and as depicted in the figures, the gears include a first gear 400 connected with the spool 304. A second gear 402 is operably connected with the first gear 400, while a third gear 404 is operably connected between the second gear 402 and the axle. Thus, rotation of the spool 304 as the band 300 returns to an unstretched state causes the gears 400, 402, and 404 to rotate and pass the rotational forces to the axle 306 and ultimately the connected wheels (e.g., rear wheels 106 (or front wheels in another aspect)) to propel the ride-on toy forward.

Figure 7A:
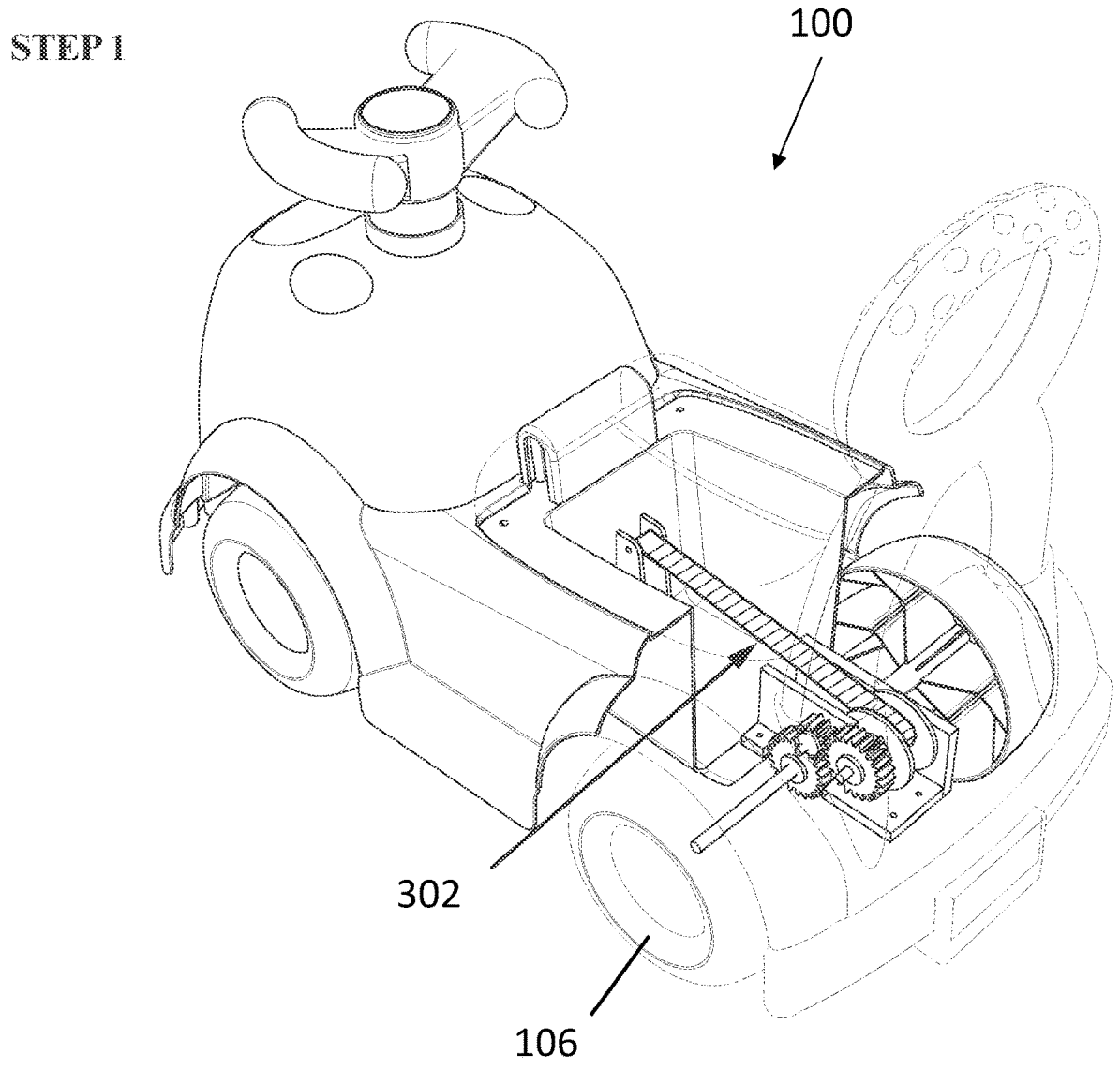
FIG. 7A is an interior-view illustration of the wind-up ride on toy, depicting the elastic band in a relaxed, unstretched state.
Figure 7B:
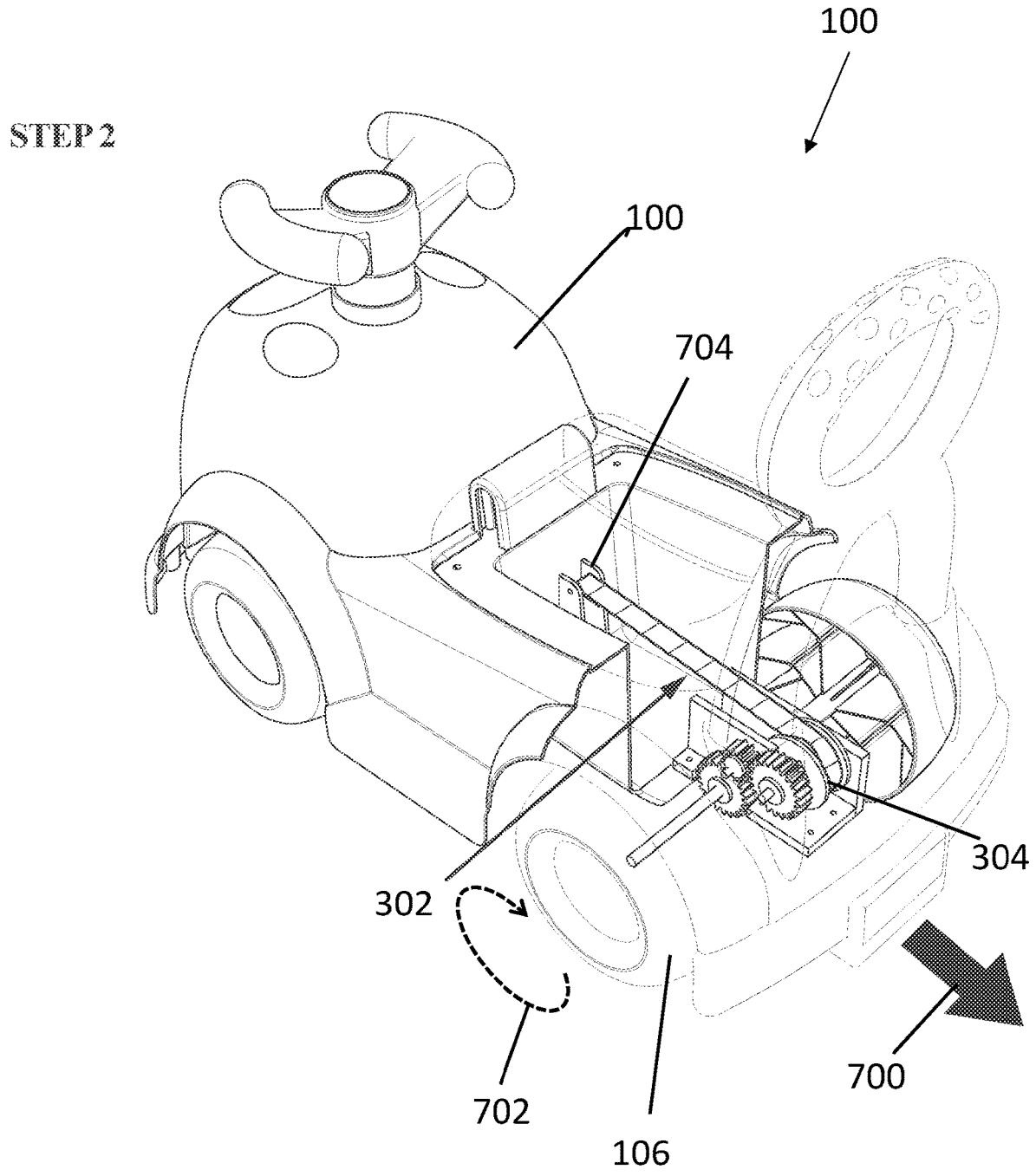
FIG. 7B is an interior-view illustration of the wind-up ride on toy, depicting the elastic band as being stretched into a stretched state.
Figure 7C:
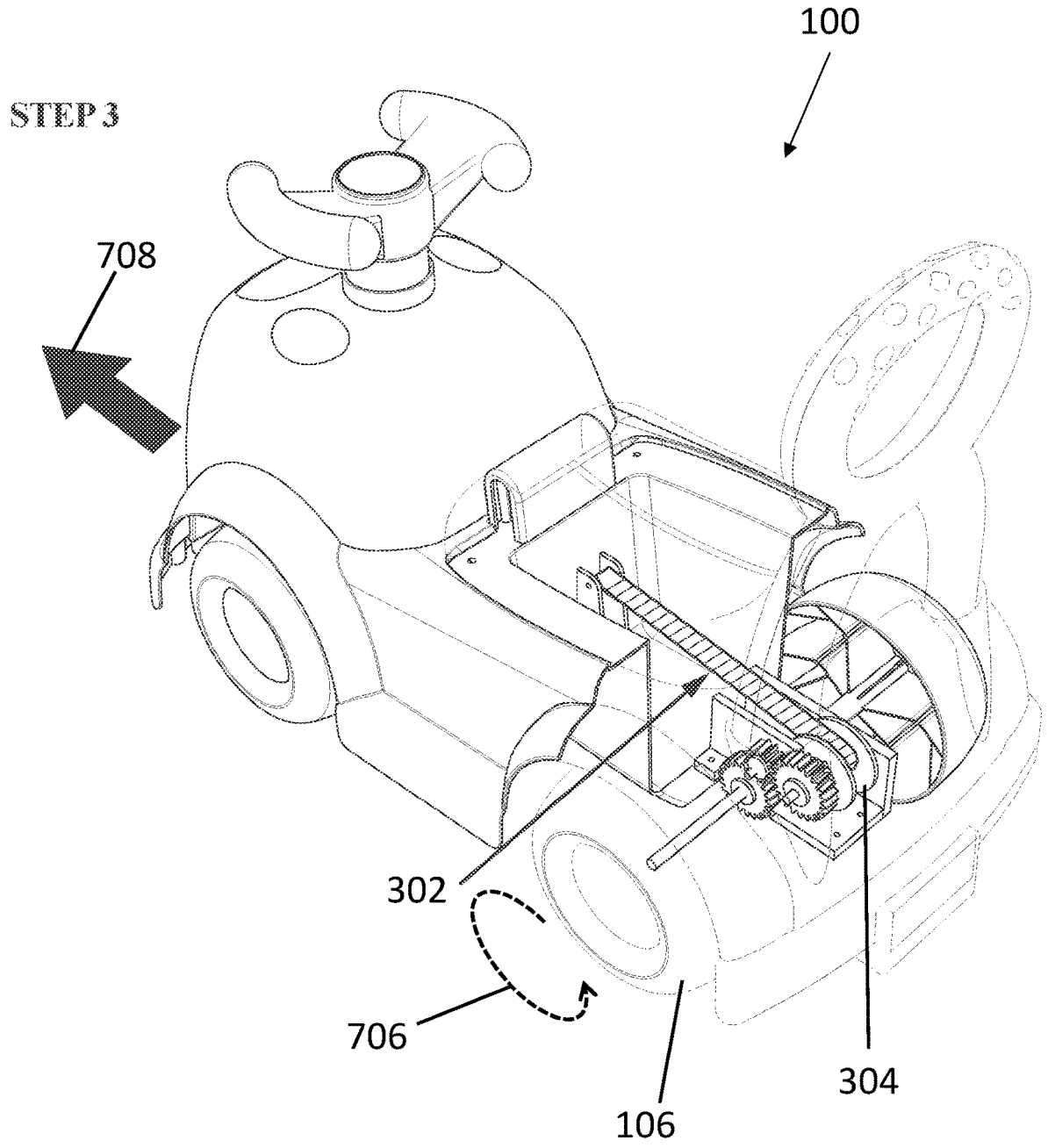
FIG. 7C is an interior-view illustration of the wind-up ride on toy, depicting the elastic band as returning to the relaxed, unstretched state and causing the wind-up ride on toy to propel forward.

For further understanding. FIG. 7A depicts the wind-up mechanism with the elastic band 302 in a relaxed, unstretched state. In a second step and as shown in FIG. 7B, as the wind-up ride on toy 100 is pulled backwards 700, the wheels 106 rotate in a first direction 702 to cause the elastic band 302 to stretch as it is wound around the spool 304. Since the elastic band 302 is fixed at a distal end 704 (first end) within the body portion and attached with the rotatable spool 304 at a second end, the band 302 is forced to stretch around the spool 304 as the spool 304 rotates, thereby created stored or potential energy within the elastic band 302.

If a user were to lift their legs after winding back the wind-up ride on toy 100, the toy 100 is propelled forward 708 as the energy is released from the band 302. In other words, as the ride-on toy 100 is released, the elastic band 302 pulls itself back toward a relaxed, unstretched state. In doing so, the band 302 rotates the spool 304, which causes the operably connected (e.g., via the gears) wheels 106 to rotate in a second direction 706 and propel the toy 100 forward 708.

Finally, while this invention has been described in terms of several embodiments, one of ordinary skill in the art will readily recognize that the invention may have other applications in other environments. It should be noted that many embodiments and implementations are possible. Further, the following claims are in no way intended to limit the scope of the present invention to the specific embodiments described above. In addition, any recitation of "means for" is intended to evoke a means-plus-function reading of an element and a claim, whereas, any elements that do not specifically use the recitation "means for", are not intended to be read as means-plus-function elements, even if the claim otherwise includes the word "means". Further, while particular method steps have been recited in a particular order, the method steps may occur in any desired order and fall within the scope of the present invention.

What is claimed is:

1. A wind-up ride on toy, comprising:

a body portion having a seat portion;

at least a first axle rotatably connected with the body portion;

a pair of wheels connected with the first axle;

a wind-up mechanism attached with the body portion, the wind-up mechanism having an elastic band and a rotatable spool, the elastic band being fixed at a first end within the body portion and being attached with the rotatable spool at a second end such that the elastic band is affixed between the first end and the rotatable spool in a direction that is perpendicular to the first axle, and wherein the elastic band has a band width and the rotatable spool has a central portion defined between a pair of flanges, the central portion having a width that is the same as the band width, and wherein the rotatable spool is operably connected with the first axle via a plurality of gears such that winding the elastic band around the spool causes the elastic band to transition from a relaxed state to a stretched state and, upon allowing the elastic band to return to the relaxed state, the spool rotates the plurality of gears to in turn rotate the first axle and pair of wheels, thereby causing the wind-up ride on toy to propel forward.

2. The wind-up ride on toy as set forth in claim 1, wherein the pair of wheels are a pair of rear wheels.

3. The wind-up ride on toy as set forth in claim 2, further comprising a pair of front wheels rotatably connected with the body portion.

4. A method for propelling a rider on a wind-up ride on toy, comprising acts of;

seating a rider upon a seat portion of the wind-up ride on toy, the seat portion being affixed upon a body portion, the body portion having a rotatable axle and pair of rear wheels attached thereto;

drawing the wind-up ride on toy backwards, such that in drawing the wind-up ride on toy backwards, an elastic band within the toy stretches around a rotatable spool to stretch from a relaxed state to a stretched state, the elastic band being fixed within the body portion of the toy and attached to the rotatable spool such that the elastic band is affixed between the body portion and the rotatable spool in a direction that is perpendicular to the first axle, and wherein the elastic band has a band width and the rotatable spool has a central portion defined between a pair of flanges, the central portion having a width that is the same as the band width; and releasing the wind-up ride on toy, such that upon releasing the wind-up ride on toy, the elastic band returns to the relaxed state and causes the spool to rotate, thereby rotating the axle and the attached pair of wheels and propelling the wind-up ride on toy and rider forward.

* * * * *